United States Patent [19]

Ulm

[11] 4,268,000

[45] May 19, 1981

[54] APPARATUS FOR FIXING SHEETS ON A BASE

[76] Inventor: Heinz J. Ulm, Seydlitzstr. 65, 8000 Munich-50, Fed. Rep. of Germany

[21] Appl. No.: 870,813

[22] Filed: Jan. 19, 1978

[30] Foreign Application Priority Data

Jan. 24, 1977 [DE] Fed. Rep. of Germany ..... 2702729
Dec. 30, 1977 [DE] Fed. Rep. of Germany ..... 2759006

[51] Int. Cl.[3] ..... A47G 1/16

[52] U.S. Cl. ..... 248/467; 24/67 AR; 24/DIG. 11; 24/304; 40/158 A; 40/603; 156/71; 156/163; 156/297; 248/205 A

[58] Field of Search ..... 40/158 A, 158 R, 155, 40/20 R, 594, 603; 24/67 AR, 73 VA, DIG. 11; 35/26, 27, 73; 156/62, 63, 71, 163, 297, 299, 494, 538, 229, 300; 248/203 A, 467

[56] References Cited

U.S. PATENT DOCUMENTS

| | | | |
|---|---|---|---|
| 2,534,961 | 12/1950 | Dunn | 40/158 R X |
| 3,031,359 | 4/1962 | Blank et al. | 24/67 AR X |
| 3,455,077 | 7/1969 | Long | 156/71 X |
| 3,766,676 | 10/1973 | Slemmons | 40/158 A |
| 3,888,029 | 6/1975 | Schubert | 40/603 |

*Primary Examiner*—John T. Goolkasian
*Assistant Examiner*—Thomas Bokan
*Attorney, Agent, or Firm*—Blanchard, Flynn, Thiel, Boutell & Tanis

[57] ABSTRACT

The specification describes a method and an arrangement for attaching flexible sheets on a base by means of holding means at the corners. One corner of the sheet is held stationarily, a second corner of the sheet is guided in one direction and in this direction it is tautened in an outward direction while a third and a fourth corner of the sheet are urged outwards without guidance by forces, which are set substantially in a direction at 45° to the edge of the sheet.

2 Claims, 6 Drawing Figures

APPARATUS FOR FIXING SHEETS ON A BASE

BACKGROUND OF THE INVENTION (1) Field to which the invention relates

The invention relates to a method and a device for attaching flexible sheets and sheet structures on a base by means of holding means at the corners.

(2) The prior art

Previously conventional methods for fixing relatively large paper sheets such as the use of adhesive tapes or material which is adhesive on both sides or fixation with drawing pins suffer from the disadvantage that when the temperature or atmospheric humidity changes, as may often occur, the different extension or contraction of the paper on the one hand and of the base on the other hand cannot be compensated for.

The effects and counter-measure taken in this respect are as follows:

When hung on the wall decorative posters and other large pictures quickly assume an uneven or wrinkled appearance and therefore make a poor general impression. On contraction of such decorative posters the strains occurring may be so pronounced that the adhesive tapes are detached and such posters fall from the wall, or on the other hand, the poster may be torn. Sometimes the posters are provided at the top and bottom edges with stuck on or clamped on rails or moldings and so hung on the wall with the result that the lower molding is suspended freely and under the action of gravity the bottom rail ensures that the poster remains more or less flat. Whether such a way of pinning up posters so that they may be caused to flutter by air currents is however a matter of taste.

Advertising posters as used in shop windows, used for drawing attention to special offers or other matters concerned with a momentary boost in sales, are usually only stuck to the window by means of adhesive applied to the surface of the poster. This offers the disadvantage that when the posters are to be changed it is always necessary to wash off the remains of adhesive. The work required and the awkwardness of using water for washing the window discourage more especially the owners of small businesses from attaching posters in this manner at all.

Drawing paper fixed to drawing boards often becomes loose and forms corrugations owing to expansion and therefore has to be drawn tight again. The frequent undoing of adhesive tapes, necessary for this purpose, on the one hand and the temporarily occurring substantial thrust stresses in the adhesive layer on the other hand (on contraction of the paper) lead to the drawing board being considerably fouled with adhesive at positions adjacent to the corners of the sheets.

SUMMARY OF THE INVENTION

Inter alia the present invention has the aim of providing an attachment method, and an attachment device or arrangement, with which paper sheets, foils etc. can be held in a completely satisfactory smooth or flat condition despite changes in temperature and atmospheric humidity and accordingly the above mentioned disadvantages are avoided.

In order to attain these and other aims the measures defined in the characterizing part of claim 1 are adopted. A device or arrangement for carrying out the method in accordance with the invention comprises the features specified in the characterizing part of claim 2.

Therefore use is made of elements, which on the one hand fulfill the basic principles of mechanics for stabilizing a rigid body and on the other hand simultaneously provide for a constant stressing of the sheet attached so that it can be regarded as a rigid body.

In the case of an even movement a rigid body has, in accordance with established principles, three degrees of freedom and it is stabilized by three restraining factors.

For decorative and advertising posters and drawing paper or foils, which are generally of rectangular form and which are attached to a vertical or obliquely set base, the following arrangement is to be recommended:

One of the two upper corners is fixed in a vertical and horizontal direction (=two restraining factors), while the other top corner is only fixed in a vertical direction (=third restraining factor) and is tautened in a horizontal direction, while the two lower corners are tautened in an outward direction at an angle of approximately 45°.

In the case of one embodiment of the invention before the fixation or attachment of decorative posters the latter are most conveniently attached with plastics elements, which, like the familiar corner mounting pockets used for photographs, fit over the corners of the article to be held. For this reason the term "corner mounting pockets" will be used for the attachment parts.

The poster corner mounting pockets extend for at least the breadth, which is necessary for sticking to the wall, beyond the edge of the poster and externally have a completely similar appearance. The fixation and tautening is preferably carried out by sticking a disk, serving as an engagement profile, on each corner of the poster and of these disks one of the two top ones is held captive stationarily in the recess of the corresponding poster mounting pocket while the other top disk is guided in the horizontal groove of the corresponding corner mounting pocket and is urged outwards by means of a spring and the two lower pockets are pressed outwards in a freely moving manner by a spring force which acts generally diagonally.

The disks to be stuck on the decorative poster can be of wood or plastics.

It is advantageous if the disks have a round form.

It is furthermore convenient if the two lower disks have a triangular shape so that, with an adhesive surface of approximately the same size, there is more space available for the diagonally tensioning springs.

Advantageously the disks can be in the form of the frustum of a cone so that the disks and accordingly the decorative poster are pressed against the wall. The rigid poster mounting pockets can be of plastics.

It is convenient if the edge of the poster mounting pockets has holes serving for driving in wall nails or if the edge of the mounting pockets is given a coating of self-adhesive composition on the side adjacent to the wall. The disks can be coated on one side with self-adhesive composition.

The spring elements in the poster mounting corners can consist of spring wire or strip spring material and be cast in position. The spring elements in the poster corner mounting pockets can be of the same material as the poster mounting pockets themselves and be produced simultaneously with them by injection molding.

It is advantageous if the spring elements are inserted after the injection operation however in order to provide a certain prestress. The spring characteristic can then be made to have a relatively gentle slope so that practically the same and constant spring forces can be ensured in the individual corners.

It is advantageous if for the individual changing a modification of the arrangement and in accordance with the individual taste of the user stick-on covers with different colours and patterns are provided for the poster corner mounts and if the latter are constructed with pleasing form and design.

The invention leads to the advantage that the poster is held completely satisfactorily in the four poster corner mounts with a perfectly even stress over the whole of its area and it is also held in the desired position. Furthermore the poster corner mounts endow the poster with a neater general impression.

The completely satisfactory stressing of the poster achieved with the arrangement in accordance with the invention, the neat overall impression, the possibility of individual adaptation as regards colour and pattern and finally the relatively low price mean that not only the poster corner mounts are themselves successful but also the production of posters themselves is boosted.

In the case of an embodiment for attaching advertising posters on shop windows fixation can be ensured by means of the poster corner mounts as already described. It is however advantageous if for this purpose the poster corner mounts are provided with elastic suckers instead of with an adhesive layer.

If advertising posters with the same dimensions are to be mounted in the same position each time it is possible to provide corresponding angular anchoring devices with suckers or with an adhesive layer which only have to be placed once in position so that the actual poster corner mounts can be connected with them in an interlocking manner and then, for changing the advertising poster only have to be lifted off and then replaced.

In accordance with the invention there is the advantage that advertising posters can be mounted in a satisfactory taut manner on shop windows using the combination described. The fixing in position and removal of such advertising posters can be carried out rapidly, without much effort and in a completely clean manner.

In the case of one embodiment for attachment of drawing paper on drawing boards the attachment means for the drawing paper on the boards is to be so flat that the shifting movement of the ruler on T-square is not hindered at all.

In order to achieve this condition thin "pivoting strips" are used for fixing and for tautening thin "tautening or tensioning strips" are used.

The pivoting and tautening strips or tapes have at their two ends in respective adhesive surface embodied in the form of familiar adhesive tape most similar material. The difference between the pivoting and the tautening strips or tapes resides in that the intermediate piece, connecting the two adhesive parts in the case of the pivoting strips consists of relatively non-stretching fabric or of filaments while in the case of the tautening strips it consists of rubber which can stretch to a considerable extent.

The pivoting strips are to have the effect of a rope while the stretching or tautening strip are to have a simple stretching or tautening action.

In accordance with the system already described for attachment in accordance with which the upper corners of the drawing paper are held stationarily, the second corner is only fixed in a vertical direction and is urged outwards horizontally, and the two lower corners are drawn outwards at approximately 45°, the pivoting and tautening strips are to be accordingly arranged.

There is the advantage in accordance with the invention that the drawing paper no longer has to be drawn tight again once it has been fixed. Furthermore fouling of the drawing board by adhesive is substantially avoided, because the thrust stresses in the adhesive layer do not reach any extreme values and the adhesive joins on the drawing board do not have to be undone and remade so often.

LIST OF SEVERAL VIEWS OF THE DRAWINGS

The invention will now be described with reference to the drawings by way of example.

DESCRIPTION OF PREFERRED EMBODIMENTS

Figure 1:
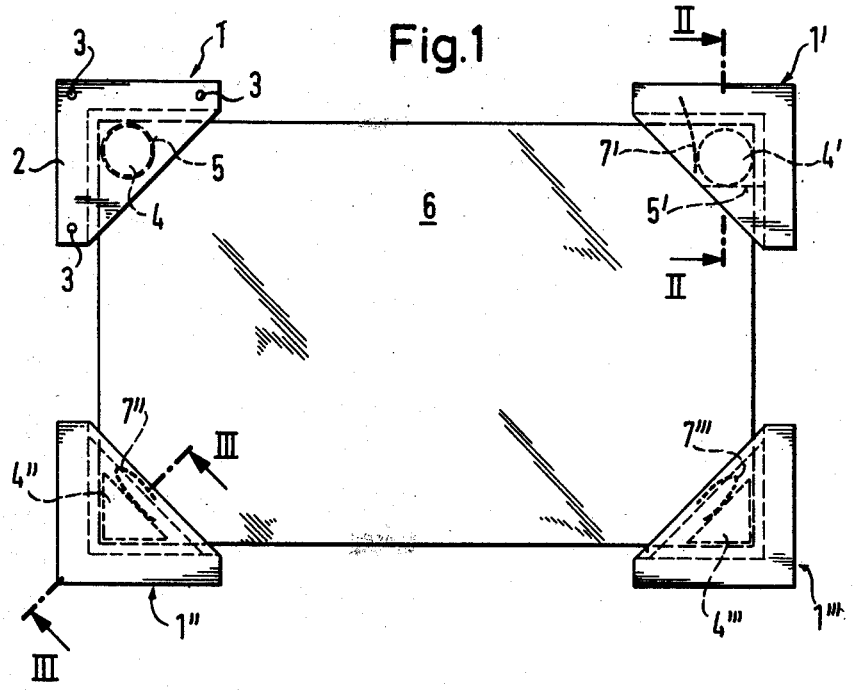
FIG. 1 shows in plan view a decorative poster, which is attached to a wall using corner mounting pockets.

Decorative poster mounting pockets 1 preferably have a triangular shape. The edge 2 which extends beyond the poster 6 offers itself as an engagement surface for the wall 8 and can be provided with holes 3 for driving in nails. Preferably the engagement surface of the mounting pockets are provided with self-adhesive coatings which produce a firm join on the wall.

On the front side of each corner of the decorative poster there is a disk 4, 4', 4'' and 4''' which is provided with a self-adhesive coating on one side. These disks serve as engagement means for the fixing and tautening elements respectively of the mounting pockets.

More particularly for reasons of easy viewing the necessary springs are represented as incast loops of spring wire, which in the case of an actual embodiment can be replaced by springs with a few turns. By suitable use of the space available it is possible to make the two lower disks round like the two other ones and not triangular as shown.

The first mounting pocket 1 only has a round recess 5, in which the associated disk 4 is held captive. The fixation of the disk 4 can however be carried out just as well using a vertical and horizontal abutment edge in the mounting pocket 1.

The second mounting pocket 1' possesses a horizontal guide groove 5' for the associated disk 4'. A horizontally acting spring 7' makes engagement with a disk 4' and tautens the decorative poster in an outer direction.

The necessary space allowed for the action of the spring is provided by moving the mounting pocket 1' a small distance horizontally outwards against the spring force before it is fixed on the wall by the setting of the adhesive layer.

The two lower mounting pockets 1'' and 1''' have a sufficiently large free space for unimpeded movement of the disks 4'' and 4'''. The springs 7'' and 7''' in these two poster mounting pockets are so arranged that they produce a force, tending to draw the poster taut, at an angle of approximately 45° to the edge of the sheet. The free spring stroke is created in this case as well by the feature that the mounting pockets 1'' and 1''' are drawn diagonally against the spring force before the final fixing on the wall.

Figure 2:
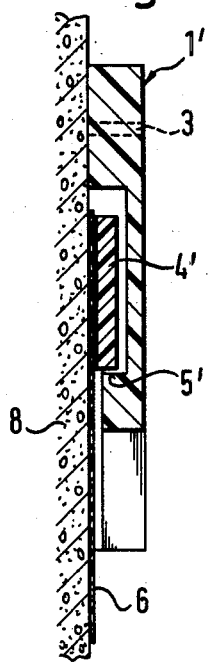
FIG. 2 is a cross-section along the section II—II indicated in FIG. 1.
Figure 3:
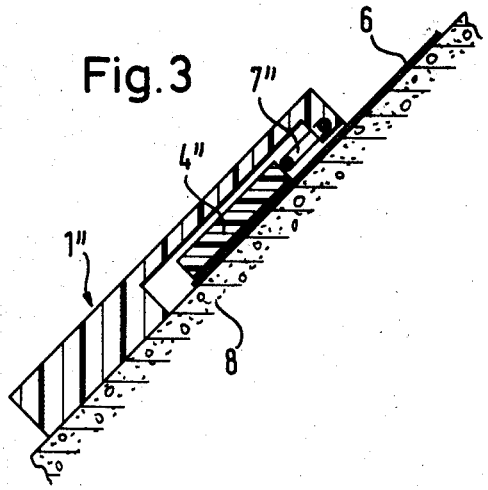
FIG. 3 is a cross-section along the section line III—III indicated in FIG. 1.
Figure 4:
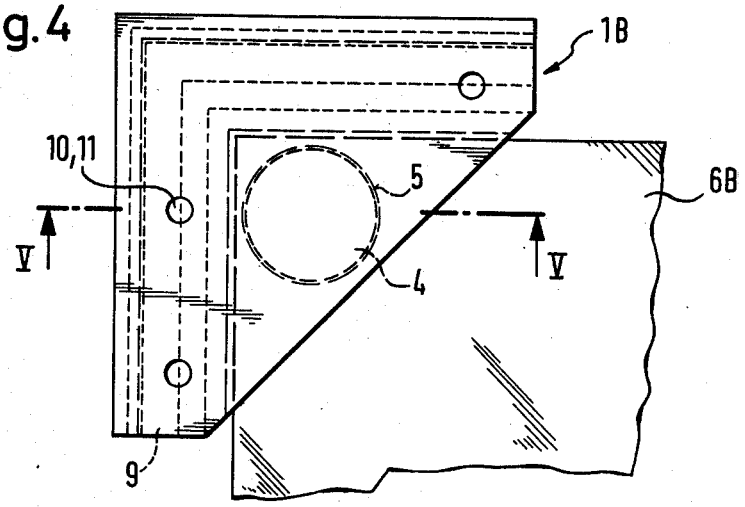
FIG. 4 shows in plan view an assembly made up of an angular anchoring device and the mounting pocket in accordance with the preferred embodiments of the invention.
Figure 5:
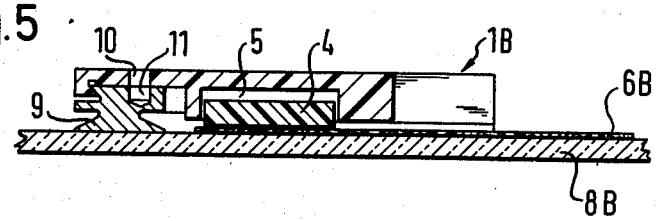
FIG. 5 is a cross-section along the section line V—V shown in FIG. 4.

The mounting pockets 1B in accordance with FIGS. 4 and 5 differ from those described in conjunction with FIGS. 1 to 3 only in that they have a rearwardly offset surface for the angular anchoring device 9 delimited in part by a half dovetail profile. The angular anchoring devices 9 can be attached either by means of conventional suction cups or by means of an adhesive layer permanently on the shop window 8B. For replacing advertising posters 6B it is then only necessary to remove the mounting pockets 1B from the half dovetail profiles and then to replace them later.

The profile shape for mounting the poster mounting 1B in the angular anchoring devices 9 can be varied as may be required.

The poster corner mounting pockets 1B and the angular anchoring devices 9 can be provided with holes 10 and 11 for the insertion of pins to fix together the loose assembly of the corner mounting pocket and the angular anchoring means to make a rigid unit Since the hole 11 may in some cases only be in the form of a blind hole in the angular anchoring device it may be appropriate to use pins which have a longitudinal groove to permit the escape of air on insertion of the pins.

Figure 6:
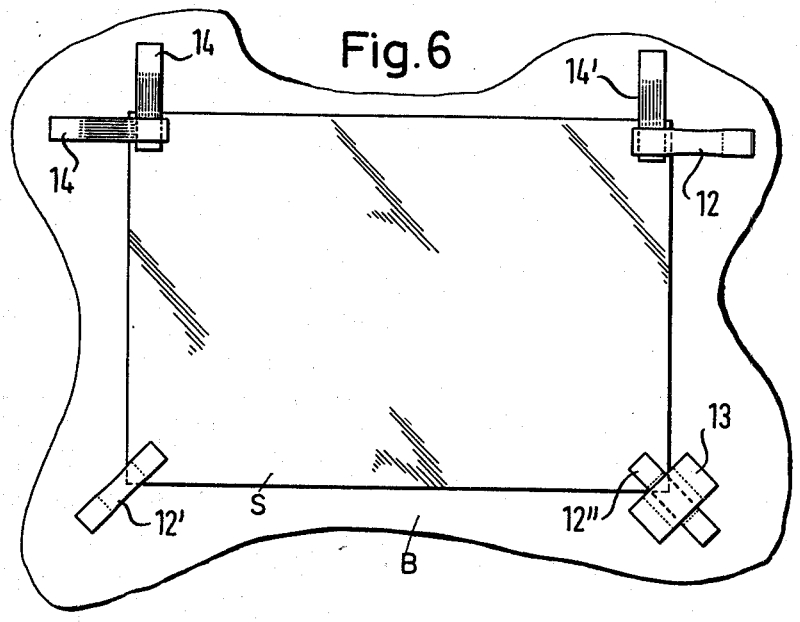
FIG. 6 shows the attachment of a sheet, more particularly on a drawing board, in accordance with a further embodiment of the invention.

In the case of the embodiment shown in FIG. 6 the top left corner of a sheet S (for example, of drawing paper) is held in position on a base B (for example, a drawing board) with two pivoting strips 14 in a vertical and horizontal direction. The right-hand top corner is held by one pivoting strip 14' in a vertical direction and urged outwards horizontally by a tautening strip 12. The two lower corners are respectively urged outwards by means of a respective tautening strip 12' and 12'' at an angle of approximately 45° to the edge of the sheet.

It is to be remarked that the left-hand upper corner could also be fixed with a simple piece of adhesive tape instead of two pivoting strips. The pivoting strips are only necessary when importance is attached to a symmetrical appearance or if the immediate surroundings of the corner must be free of vestiges of adhesive.

The connecting piece between the adhesive joins (in the case of the pivoting strips threads or fabric and in the case of the tautening strip for example rubber) can be protected additionally by covering strips 13. These covering strips 13 can be normal adhesive tapes, which in the center are not provided with adhesive or at this position are covered by a stuck on foil.

Furthermore it is possible in accordance with a further advantageous development of the invention only to use tautening strips which at all four corners of the sheet are set an an angle of 45° to the edge of the sheet and to the four corners of the sheet outwards.

I claim:

1. An apparatus for attaching flexible sheets onto a base by holding a first corner of the sheet stationarily, by guiding a second and adjacent corner for expansion and contraction movement in a direction away from said first corner while tensioning the sheet outwardly along said direction, and by tensioning third and fourth corners of the sheet outwardly substantially at an angle of 45° with respect to the adjacent edge of the sheet and without guidance, wherein the apparatus comprises the combination of:

a base;

a flexible sheet;

laterally, flexible, nonextensible pivoting strips applied in interconnecting relation from said base to said first corner of said flexible sheet for stationarily holding the latter and to said second corner of said sheet for guiding same in said direction;

a resiliently extensible tensioning strip applied in interconnecting relation to said base and said second corner of said sheet for tensioning of said sheet outward in said direction; and further resiliently extensible tensioning strips applied in interconnecting relation to said base and third and fourth corners of said flexible sheet for said urging of said corners outward substantially at said 45° angle, said pivoting strips and tensioning strips each having one end adhesively secured to the corresponding corner of said sheet and their opposite ends adhesively secured to said base, and holding said sheet flush against the surface of said base, in which said strips at said first corner comprise first and second pivoting strips having respective first adhesively surfaced ends fixed atop said first corner of said sheet, said first and second pivoting strips respectively being applied in a horizontal direction and a vertical direction to said first corner and having outer adhesively faced ends adhesively fixed to the surface of said base, with the intermediate portion of said first and second nonextensible pivoting strips being nonadhesively faced and thereby free to flex laterally with respect to said sheet and base;

said strips at said second corner comprising a third nonextensible pivoting strip and a first tensioning strip having a resiliently extensible central portion, said third pivoting strip and first tensioning strip having adhesively faced inner ends adhesively secured to the outwardly facing surface of said sheet at said second corner, said third nonextensible pivoting strip extending outward beyond said second corner in a direction substantially parallel to the adjacent one of said first and second nonextensible pivoting strips at said first corner and having an adhesively faced outer end surface adhesively fixed to the surface of said base, said first tensioning strip extending outward from said sheet substantially in a direction opposite that of the other of said first and second pivoting strips and substantially perpendicular to said third pivoting strip and having an outer end adhesively fixed to the surface of said base, said third pivoting strip and first tensioning strip each having central portions between their adhesively faced ends, which central portions are faced nonadhesively and are respectively nonextensible and resiliently extensible, said sheet having a first edge connecting said first and second corners, said one and third nonextensible pivoting strips preventing movement of said first edge of said sheet in a direction toward the opposite edge of said sheet while resiliently permitting expansion and contraction of said sheet along said first edge thereof;

said strips at said third and fourth corners of said sheet comprising a second extensible tensioning strip at said third corner and a third extensible tensioning strip at the fourth corner of said sheet, said second and third tensioning strips each having an adhesively faced inner end overlying and adhesively fixed to the respective third and fourth corner of said sheet, said second and third tensioning strips extending outward from said third and fourth corners, respectively, substantially at a 45° angle to said opposite sheet edge and terminating in adhesively faced outer ends adhesively secured to the surface of said base, said second and third tensioning strips each having a nonadhesive but resiliently stretchable central portion not fixed directly to said sheet or base and which is normally tensioned to hold said sheet snugly and flatly against said surface of said base.

2. The apparatus of claim 1, in which the central portions of said extensible tensioning strips are longitudinally extensible, and additionally including covering strips overlying the nonadherent central portions of said tensioning and pivoting strips for protecting such nonadhesive portions while being sufficiently shorter than the pivoting and tensioning strips as not to overlie the adhesive faced end portions thereof, said covering strips being substantially wider than the central portions of said pivoting and tensioning strips and having adhesively faced side edge portions lying sidewardly outboard of said central portions of said pivoting and tensioning strips for adhesively engaging said base without adhesive engagement of said sheet and pivoting and tensioning strips, the central portion of said covering strips being nonadherent to and wider than said central portions of said pivoting and tensioning strips, whereby said covering strips protect the central portions of said tensioning and pivoting strips while permitting at least limited lateral flexing and longitudinal change of length, respectively, thereof.

* * * * *